US011939836B2

(12) United States Patent
Watkins et al.

(10) Patent No.: US 11,939,836 B2
(45) Date of Patent: Mar. 26, 2024

(54) PORT SUB WITH DELAYED OPENING SEQUENCE

(71) Applicant: ADVANCED UPSTREAM LTD., Calgary (CA)

(72) Inventors: Tom Watkins, Calgary (CA); Jeyhun Najafov, Calgary (CA)

(73) Assignee: Advanced Upstream Ltd., Calgary (CA)

( * ) Notice: Subject to any disclaimer, the term of this patent is extended or adjusted under 35 U.S.C. 154(b) by 0 days.

(21) Appl. No.: 17/211,505

(22) Filed: Mar. 24, 2021

(65) Prior Publication Data

US 2022/0065070 A1 Mar. 3, 2022

Related U.S. Application Data

(60) Provisional application No. 63/072,862, filed on Aug. 31, 2020.

(51) Int. Cl.

| | |
|---|---|
| ***E21B 34/06*** | (2006.01) |
| ***E21B 34/10*** | (2006.01) |
| *E21B 47/06* | (2012.01) |

(52) U.S. Cl.

CPC ..... *E21B 34/063* (2013.01); *E21B 34/108* (2013.01); *E21B 47/06* (2013.01); *E21B 2200/08* (2020.05)

(58) Field of Classification Search

CPC ..... E21B 34/063; E21B 34/108; E21B 47/06; E21B 2200/08

See application file for complete search history.

(56) References Cited

U.S. PATENT DOCUMENTS

| | | | |
|---|---|---|---|
| 4,979,569 | A | 12/1990 | Anyan et al. |
| 5,819,853 | A | 10/1998 | Patel |
| 7,451,815 | B2 | 11/2008 | Hailey, Jr. |
| 8,863,850 | B2 | 10/2014 | Sherman et al. |
| 9,441,440 | B2 | 9/2016 | Hofman et al. |
| 9,441,446 | B2 | 9/2016 | Fripp et al. |
| 9,650,851 | B2 | 5/2017 | Whitsitt et al. |
| 9,752,412 | B2 | 9/2017 | Shkurti et al. |
| 9,816,350 | B2 | 11/2017 | Mailand et al. |

(Continued)

FOREIGN PATENT DOCUMENTS

| | | | |
|---|---|---|---|
| CA | 2901074 | A1 | 12/2016 |
| GB | 2556480 | B | 5/2019 |

*Primary Examiner* — Christopher J Sebesta

(74) *Attorney, Agent, or Firm* — Smart & Biggar LP

(57) ABSTRACT

A port sub comprises one or more standard flow ports, each having a low-pressure port assembly positioned therein to, and at least one control flow port having a high-pressure port assembly positioned therein. The low-pressure port assembly comprises an inner layer having a first rupture pressure and an outer layer configured to remain intact upon the rupturing of the inner layer. The high-pressure port assembly comprises an inner layer having a second rupture pressure that is greater than the first rupture pressure. The high-pressure port assembly is configured to be broken through upon the rupturing of its inner layer to allow fluid flow through the at least one control flow port, thereby allowing a dissolve fluid to flow therethrough to facilitate the disintegration of the outer layer of the low-pressure port assembly to open the one or more standard flow ports.

34 Claims, 3 Drawing Sheets

(56) References Cited

U.S. PATENT DOCUMENTS

| | | | | |
|---|---|---|---|---|
| 10,036,229 | B2 | 7/2018 | Bacsik et al. | |
| 10,066,461 | B2 | 9/2018 | Hardesty et al. | |
| 10,156,126 | B2 | 12/2018 | Hardesty et al. | |
| 10,208,570 | B2 | 2/2019 | Hardesty et al. | |
| 10,253,597 | B2 | 4/2019 | Hardesty et al. | |
| 10,273,780 | B2 | 4/2019 | Garcia et al. | |
| 2013/0222148 | A1* | 8/2013 | Gano | G01V 11/00 340/853.3 |
| 2014/0318780 | A1 | 10/2014 | Howard | |
| 2015/0240587 | A1* | 8/2015 | Peterson | C09K 8/422 166/296 |
| 2016/0208575 | A1* | 7/2016 | Bellavance | E21B 34/063 |
| 2017/0247996 | A1* | 8/2017 | Hardesty | E21B 33/1208 |
| 2018/0328139 | A1* | 11/2018 | Mhaskar | E21B 34/063 |
| 2020/0095845 | A1 | 3/2020 | Watkins et al. | |

* cited by examiner

PORT SUB WITH DELAYED OPENING SEQUENCE

CROSS-REFERENCE TO RELATED APPLICATION

This application claims the benefit of U.S. Provisional Patent Application Ser. No. 63/072,862, filed on Aug. 31, 2020, the content of which is hereby incorporated by reference in its entirety.

FIELD

The present disclosure relates to a port sub for use in downhole operations and more particularly to a port sub with a plurality of ports to provide an opening sequence which may be useful for pressure testing and/or actuating a wellbore tool, such as a hydraulically actuated tool, and to related methods.

BACKGROUND

Trican Well Service Ltd. developed the first "toe port sub" as part of its the Burst Port System® ("BPS"). The Trican toe port sub, installed near the bottom ("toe") of a wellbore, enables an operator to open one or more flow ports between the wellbore and the formation at the distal end of the wellbore. The flow ports are designed to open at precise pressures to provide the operator more control over the diversion of the fractures. The flow ports enable a first ball of a ball drop completion to be circulated into the wellbore or a first set of perforating guns to be pumped into the wellbore. Prior to the development of BPS, coiled tubing or tractors were used to shift the first ball drop sleeve open or convey perforation guns into the wellbore.

Some jurisdictions require a pressure test of the casing string of the wellbore to 80% to 100% of the casing yield pressure. The test is to check for leaks in the casing string that could lead to contamination of ground water or issues with zonal isolation. During the casing pressure test, the hydrostatic pressure inside the wellbore can be as high as about 42 MPa (about 6000 psi). Taking into account the existing hydrostatic pressure at the toe of the wellbore, the actual pressure at the toe during the casing pressure test is considerably greater than the test pressure in the casing near the surface. Therefore, the toe port sub, installed at the toe of the wellbore, is exposed to pressures much greater than the surface test pressure. While factors such as fluid density of the test fluid may not be a concern near surface, such factors may have a significant effect on the actual pressure experienced by the toe port sub, due to the additional hydrostatic pressure at the toe of the wellbore.

The Trican BPS or any system that relies on precise pressures to open flow ports does not allow a casing pressure test to be conducted because the burst disks or sliding sleeves typically used in such a system for opening the flow ports cannot withstand the actual test pressure without inadvertently opening the flow ports. To overcome this issue, it is common practice to install a ball seat in the casing string directly above the toe port. When a flow port at the toe is accidentally opened during the pressure test, a dissolvable ball is pumped into the ball seat to stop fluid flow through the open flow port so that the casing pressure test can be completed. The dissolvable ball subsequently dissolves, and the open flow port can be used to circulate the first ball of a ball drop completion or perforation guns into the wellbore.

The use of a dissolvable ball and ball seat increases the cost of wellbore operations. Another disadvantage of the dissolvable ball and ball seat configuration is that it slows down wellbore operations because it takes time to pump the ball down to the seat.

Some prior art flow ports have an outer cap that is displaced into the wellbore when the flow port is opened and, once displaced, such a cap can leave debris in the wellbore which could block flow paths and impede production of the subterranean formation.

In other wellbore operations, one or more hydraulically actuated tools may be installed in a wellbore, for example, as a component in a wellbore string, and such tools typically have mechanisms that are driven by hydraulic pressure. Such mechanisms may include burst inserts, sleeves, pistons, etc. Pressures communicated through the wellbore, for example, through the string via one or more flow ports may be used to selectively actuate the tools. More specifically, the flow ports are opened to hydraulically actuate the tools. However, the is a risk that the mechanism of a hydraulically actuated tool can be actuated prematurely if there is a pressure spike in the wellbore. In particular, during a casing pressure test, if the flow ports are accidentally opened due to the test pressures then the tool's mechanism will function prematurely.

In U.S. Patent Publication No. 2020/0095845, the content of which is hereby incorporated by reference in its entirety, the Applicant developed a port sub having a port assembly that allows the delayed opening of a flow port. The port assembly is placed in the flow port and generally comprises a burst disk that is placed adjacent to the inner surface of the port sub and a dissolvable barrier that is spaced apart from the burst disk to define an atmospheric cavity therebetween. The dissolvable barrier is configured to be broken through after the burst disk is ruptured and after a breakthrough time has lapsed. Accordingly, during casing pressure testing, the burst disk is broken but the dissolvable barrier remains intact to restrict fluid flow through the flow port. Once the breakthrough time has lapsed, the dissolvable barrier is broken through and fluid can flow through the flow port. However, it may be difficult to accurate predict and/or control the breakthrough time of the dissolvable barrier.

Accordingly, a need exists for an alternative port sub having delayed opening flow ports that is configured to allow more control over the selective opening of the flow ports.

SUMMARY

According to a broad aspect of the present disclosure, there is provided a port sub comprising: a wall having defined therein a standard flow port and a control flow port; a low-pressure port assembly disposed in the standard flow port, the low-pressure port assembly comprising: a low-pressure inner layer having a first rupture pressure; and a low-pressure outer layer, a least a portion of the low-pressure outer layer being spaced apart from the low-pressure inner layer to define a first chamber therebetween, the low-pressure port assembly having an intact position, an interim position, and an open position, wherein in the intact position, both the low-pressure inner layer and low-pressure outer layer are intact; in the interim position, the low-pressure inner layer is ruptured and the low-pressure outer layer is intact; and in the open position, the low-pressure inner layer is ruptured and the low-pressure outer layer is broken through; a high-pressure port assembly disposed in the control flow port, the high-pressure port assembly comprising: a high-pressure inner layer having a second rupture pressure, the second rupture pressure being greater than the first rupture pressure; and a high-pressure outer layer configured to rupture immediately after rupturing of the high-pressure inner layer, a least a portion of the high-pressure outer layer being spaced apart from the high-pressure inner layer to define a second chamber therebetween, the high-pressure port assembly having an intact position and an open position, wherein in the intact position, both the high-pressure inner layer and high-pressure outer layer are intact; and in the open position, both the high-pressure inner layer and the high-pressure outer layer are ruptured.

In some embodiments, when the low-pressure port assembly is in the intact position and the interim position, fluid flow through the standard flow port is restricted; and when the low-pressure port assembly is in the open position, fluid flow through the standard flow port is permitted.

In some embodiments, when the high-pressure port assembly is in the intact position, fluid flow through the control flow port is restricted; and when the high-pressure port assembly is in the open position, fluid flow through the control flow port is permitted.

In some embodiments, the high-pressure outer layer has a third rupture pressure, the third rupture pressure being less than the second rupture pressure.

In some embodiments, the third rupture pressure is less than the first rupture pressure.

In some embodiments, the third rupture pressure is around 1% of the second rupture pressure.

In some embodiments, the first rupture pressure is a test pressure of a downhole tubing in a wellbore.

In some embodiments, the low-pressure outer layer is a dissolvable barrier configured to dissolve when exposed to a dissolve fluid.

In some embodiments, the low-pressure inner layer is a burst disk.

In some embodiments, the high-pressure inner layer is a burst disk and the high-pressure outer layer is a burst disk or a dissolvable barrier.

According to another broad aspect of the present disclosure, there is provided a method for selectively opening a plurality of flow ports in a port sub, the plurality of flow ports comprising a standard flow port and a control flow port, the standard flow port having a low-pressure port assembly disposed therein, the control flow port having a high-pressure port assembly disposed therein, the low-pressure port assembly and the high-pressure port assembly being intact to block fluid flow through the standard flow port and the control flow port, respectively, the method comprising: increasing a pressure inside the port sub to a first pressure to partially rupture the low-pressure port assembly, leaving a remainder of the low-pressure port assembly to continue to block the control flow port; increasing the pressure inside the port sub to a second pressure, the second pressure being greater than the first pressure, to break through the high-pressure port assembly to unblock the control flow port; and introducing a fluid into the port sub to dissolve the remainder of the low-pressure port assembly to unblock the standard flow port.

In some embodiments, the method comprises, prior to increasing the pressure inside the port sub to the first pressure, connecting the port sub to a downhole tubing and running the downhole tubing into a wellbore.

In some embodiments, connecting the port sub comprises connecting the port sub to a distal end of the downhole tubing and wherein running the downhole tubing into the wellbore comprises running the downhole tubing into the wellbore until the port sub is adjacent a toe of the wellbore.

In some embodiments, increasing the pressure comprises introducing a fluid into the port sub via an inner bore of the downhole tubing.

According to another broad aspect of the present disclosure, there is provided a port assembly for use in a flow port defined in a wall of a port sub, the port assembly comprising: a burst disk for placement in the flow port to abut against an outward-facing shoulder in the wall; a dissolvable barrier for placement in the flow port, the dissolvable barrier having an inner surface with a recessed portion and a non-recessed portion; and a retainer member configured to directly connect to the wall for securing the burst disk and the dissolvable barrier in the flow port, wherein when the port assembly is installed in the flow port, the non-recessed portion is in direct contact with the burst disk and the recessed portion is spaced apart from the burst disk to define a chamber therebetween, and when the burst disk and the dissolvable barrier are intact, fluid flow through the flow port is restricted, and when the when the burst disk is ruptured and dissolvable barrier is broken through, fluid flow through the flow port is permitted.

In some embodiments, the retainer member has defined therein an inner bore configured to receive at least a portion of the dissolvable barrier.

In some embodiments, the retainer member has defined therein an inward-facing shoulder for restricting movement of the dissolvable barrier when the port assembly is installed in the flow port.

In some embodiments, the retainer member is configured to threadedly connect to the wall.

In some embodiments, the dissolvable barrier has one or more thinner areas.

According to another broad aspect of the present disclosure, there is provided a method of installing a port assembly in a flow port defined in a wall of a port sub, the port assembly comprising an inner layer, an outer layer having a first surface with a recessed portion and a non-recessed portion, and a retainer member, the method comprising: placing the inner layer into the flow port to abut against an outward-facing shoulder of the wall; inserting the outer layer into an inner bore of the retainer member, with a second surface of the outer layer facing an inward-facing shoulder in the retainer member and the first surface facing away from the inward-facing shoulder; placing the retainer member and the outer layer into the flow port, with the first surface facing the inner layer; and securing the retainer member to the wall, wherein movement of the inner layer and outer layer is restricted by the inward-facing and outward-facing shoulders and a chamber is defined between the recessed portion and the inner layer.

In some embodiments, securing the retainer member comprises threadedly connecting the retainer member to the wall.

In some embodiments, the inner layer is a burst disk and the outer layer is a dissolvable barrier.

The details of one or more embodiments are set forth in the description below. Other features and advantages will be apparent from the specification and the claims.

BRIEF DESCRIPTION OF THE DRAWINGS

The invention will now be described by way of an exemplary embodiment with reference to the accompanying simplified, diagrammatic, not-to-scale drawings. Any dimensions provided in the drawings are provided only for illustrative purposes, and do not limit the invention as defined by the claims. In the drawings:

DETAILED DESCRIPTION OF THE EMBODIMENTS

Figure 1:
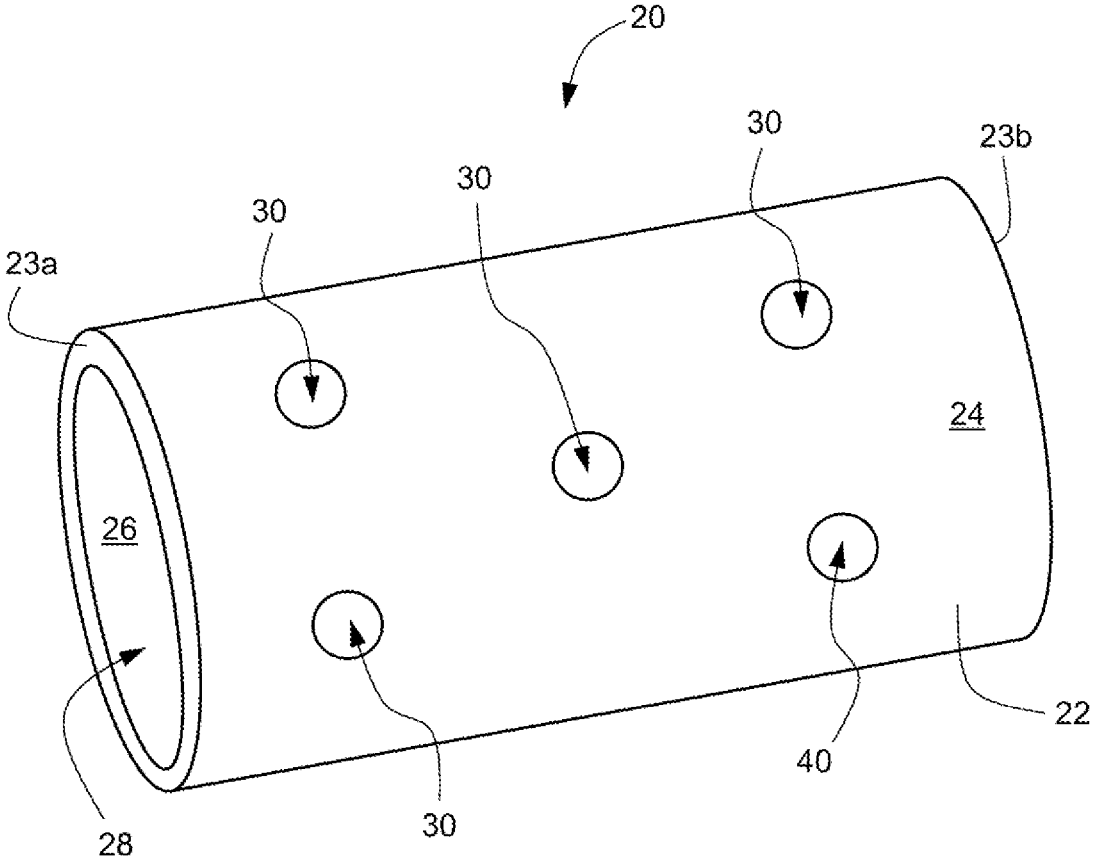
FIG. 1 is a perspective view of a port sub having a plurality of standard flow ports and a control flow port, according to one embodiment of the present disclosure.

When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the scope of the invention, as defined in the appended claims.

According to embodiments herein, a port sub is provided having a plurality of flow ports, each having a respective port assembly for controlling fluid flow therethrough. In some embodiments, the plurality of flow ports comprises one or more standard flow ports and at least one control flow port. Each standard flow port has a respective low-pressure port assembly positioned therein and each control flow port has a respective high-pressure port assembly positioned therein. Each of the low-pressure port assembly and high-pressure port assembly comprises a respective inner layer and outer layer.

In some embodiments, the inner layer of the low-pressure port assembly ("low-pressure inner layer") comprises a low-pressure burst disk and the outer layer of the low-pressure port assembly ("low-pressure outer layer") comprises a dissolvable barrier. In some embodiments, the inner layer of the high-pressure port assembly ("high-pressure inner layer") comprises a high-pressure burst disk and the outer layer of the high-pressure port assembly ("high-pressure outer layer") comprises a dissolvable material and/or a second burst disk. In each port assembly, a chamber is defined between an outer surface of the inner layer and an inner surface of the outer layer. The low-pressure inner layer is configured to be broken at a lower rupture pressure than the high-pressure inner layer. In some embodiments, the low-pressure burst disk is selected to have a lower rupture pressure than that of the high-pressure burst disk. In some embodiments, the high-pressure outer layer is configured to rupture almost immediately after the high-pressure inner layer (e.g., the high-pressure burst disk) is ruptured.

In operation, the fluid pressure inside the port sub is increased to a first pressure that is equal to or higher than the rupture pressure of the low-pressure inner layer but is lower than the rupture pressure of the high-pressure inner layer so that the low-pressure inner layer bursts while the high-pressure port assembly remains intact. When the low-pressure inner layer ruptures, the corresponding standard flow port remains blocked by the low-pressure outer layer. The fluid pressure inside the port sub is subsequently increased to a second pressure that is equal to or higher than the rupture pressure of the high-pressure inner layer to rupture the high-pressure inner layer. In some embodiments, almost immediately after the high-pressure inner layer is ruptured, the high-pressure outer layer also ruptures, thereby opening the corresponding control flow port to allow fluid to flow therethrough. In some embodiments, a dissolve fluid having a corrosive material, such as acid and/or salt, can be introduced into the port sub and allowed to flow out through the open control flow port to help dissolve the low-pressure outer layer from inside and outside the port sub, to thereby accelerate the opening of the standard port(s) in the port sub, which may help ensure that all flow ports in the port sub are eventually opened. The port sub of the present disclosure thus enables an operator to choose when to fully open the flow ports of the port sub.

With reference to FIG. 1, a port sub 20 comprises a tubular wall 22 having an outer surface 24 and an inner surface 26. Inner surface 26 defines an inner axial bore 28. The wall 22 has one or more standard flow ports 30 and at least one control flow port 40, each extending between the inner surface 26 and the outer surface 24 to allow fluid communication between the inner bore 28 and the space external to the port sub 20. Each standard flow port 30 has a respective low-pressure port assembly positioned therein. Each control flow port 40 has a respective high-pressure port assembly positioned therein.

While the illustrated port sub 20 has multiple standard flow ports 30 and one control flow port 40, the port sub 20 may have fewer and more standard flow ports 30 and/or control flow ports 40 in other embodiments. In some embodiments, the port sub 20 may have an inner diameter in a range of about 1" and about 10" and an outer diameter in a range of about 3" and about 12". In some embodiments, the wall 22 may have a thickness in a range of about 1" and about 4". In some embodiments, flow ports 30,40 may have a diameter in a range of about 0.25" and about 1".

The port sub 20 has a first end 23*a* and a second end 23*b*, each configured for connection with a downhole tubing, such as a production string, an injection string, a liner, a casing, etc., such that port sub 20 can be part of the downhole tubing to be placed in a wellbore. Port sub 20 may be used in an open hole or cement application. In some embodiments, the first and second ends may be internally or externally threaded for connection with the downhole tubing.

There are many possible ways to connect the port sub 20 to the downhole tubing, including for example: integrating the port sub 20 with the downhole tubing such that the port sub 20 forms a portion thereof; circumferentially supporting the port sub 20 on the outer surface of the downhole tubing; positioning the port sub 20 in the inner bore of the downhole tubing, etc. In some embodiments, when the port sub 20 is connected to the downhole tubing, the inner bore 28 of the port sub 20 is in fluid communication with the inner bore of the downhole tubing. In some embodiments, two or more port subs 20 may be connected to the same downhole tubing.

In some embodiments, the port sub 20 is connected to a distal end of the downhole tubing, such that after the downhole tubing is run into the wellbore, the port sub 20 is positioned at or near the toe of the wellbore. In this embodiment, the port sub 20 may be referred to as a "toe sub". In some embodiments, the port sub 20 is positioned in an area of a reservoir in a subterranean formation. The subterranean reservoir may contain hydrocarbons including oil and/or gas.

Figure 2:
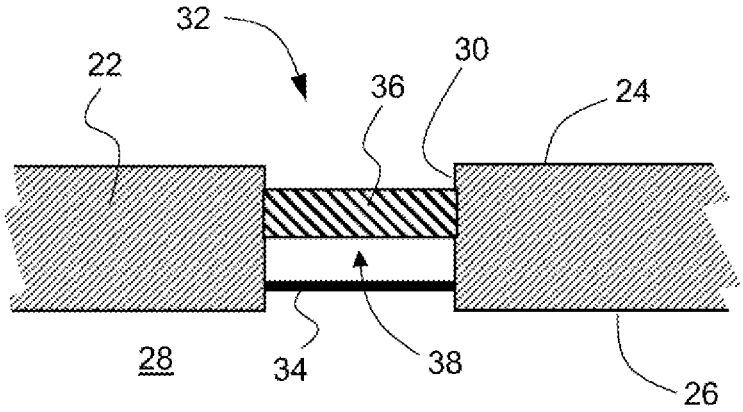
FIG. 2 is a cross-sectional view of a low-pressure port assembly disposed in a standard flow port of the port sub of FIG. 1. The low-pressure port assembly is shown in an intact position.

FIG. 2 shows a sample embodiment of a low-pressure port assembly 32. The low-pressure port assembly 32 may be wholly or partially disposed in the standard flow port 30. In some embodiments, the low-pressure port assembly 32 is positioned between the outer surface 24 and inner surface 26 of wall 22. In other embodiments, at least a portion of the port assembly 32 extends beyond the inner surface 26 and/or outer surface 24 of the wall 22. In some embodiments, the port assembly 32 is secured to the wall 22 of the port sub by threaded connection. The port assembly 32 is configured to control the opening of its corresponding standard flow port 30 as described in detail below.

Each low-pressure port assembly 32 generally comprises an inner layer 34 (also referred to as "low-pressure inner layer") and an outer layer 36 (also referred to as low-pressure outer layer"). The port assembly 32 is disposed in the wall 22 of the port sub such that the inner layer 34 is adjacent to the inner surface 26 and the outer layer 36 is adjacent to the outer surface 24. Inner layer 34 is thus closer to inner bore 28 than outer layer 36. In some embodiments, the outer layer 36, when intact, is configured to shield the inner layer 34 from fluid pressures outside the port sub. In some embodiments, inner layer 34 is a burst disk and outer layer 36 is a dissolvable barrier.

When the inner layer 34 and outer layer 36 are intact, a chamber 38 is defined between an inner surface of the outer layer 36 and the outer surface of the inner layer 34. In some embodiments, at least a portion of the outer layer 36 is spaced apart from the inner layer 34 to define chamber 38. In some embodiments, chamber 38 contains a compressible fluid. In some embodiments, the fluid in chamber 38 is at about atmospheric pressure.

The port assembly 32 has an intact position, an interim position, and an open position. The low-pressure port assembly 32 is shown in the intact position in FIG. 2, wherein the inner layer 34 and outer layer 36 are intact to block (i.e., close) the standard flow port 30 such that no fluid can flow through port 30. In the intact position, the inner layer 34 separates the outer layer 36 from the inner bore 28. In the interim position, the inner layer 34 is ruptured, thereby allowing fluid communication between the inner bore 28 and the outer layer 36. In the interim position, disintegration of the outer layer 36 may occur depending on the material of the outer layer 36, the composition of the fluid in inner bore 28, and the temperature of the port sub's surroundings (i.e., the downhole temperature in the wellbore). In some embodiments, the outer layer 36 may be configured to only dissolve when exposed to a dissolve fluid having certain constituents, for example a particular salt and/or acid. In the interim position, although burst disk 34 has ruptured, the flow port 30 remains blocked by the outer layer 36 such that no fluid can flow through port 30. In the open position, at least part of the outer layer 36 has disintegrated enough to provide a flow passage through which fluid can flow, thereby opening the standard flow port 30.

In some embodiments, inner layer 34 is a burst disk that is configured to withstand pressures up to a predetermined pressure ("rupture pressure") and to rupture when the pressure it is exposed to reaches the rupture pressure. The rupture pressure of the burst disk is the sum of the maximum hydrostatic pressure, the maximum pressure expected during the cement plug test (i.e., bumping the plug), and a safety margin to account for water hammer effects, gauge accuracy, and operator error. The port sub of the present disclosure is configured taking into account the hydrostatic pressure of the cement blend such that the burst disk does not rupture during cementing operations. The rupture pressure of burst disk of the inner layer 34 is selected so that the burst disk is ruptured during the casing integrity pressure test. For example, the rupture pressure of the burst disk of inner layer 34 may be about 8,000 psi. The chamber 38 provides a space for the inner layer 34 to expand into when the inner layer 34 ruptures. Once inner layer 34 is ruptured, fluid in the inner bore 28 of the port sub can flow past the ruptured inner layer 34 to reach outer layer 36.

In some embodiments, the outer layer 36 is a dissolvable barrier configured to block fluid flow when intact and to dissolve when exposed to fluid (e.g., a dissolve fluid) in the inner bore of the port sub and/or the outer surface of the port sub. The dissolvable barrier has an overall thickness, i.e., the distance between its outer surface and its inner surface, and in some embodiments, the overall thickness may range between about 1/16" and about 3/8". The dissolvable barrier may comprise one or more of: aluminum, aluminum alloy, aluminium, magnesium, magnesium alloy, zinc alloy, polylactic acid, polylactic acid copolymer, polyvinyl acetate, polyvinyl acetate copolymer, and other suitable materials as known to those skilled in the art. The material of the dissolvable barrier may be selected to dissolve in acid(s) and/or fluid(s) containing salt(s). The material of the dissolvable barrier may further fulfill some requirements for material strength, in addition to the requirement(s) for dissolvability or solubility.

The dissolvable barrier has a breakthrough time, i.e., the time it takes for the dissolvable barrier to dissolve enough to allow fluid to flow therethrough, and the breakthrough time depends on a number of factors including the configuration of the dissolvable barrier (e.g., its overall thickness), the material of the dissolvable barrier, the composition of the fluid in contact with the dissolvable barrier, and the temperature of the port sub's surroundings (e.g., the wellbore). In some embodiments, the breakthrough time is selected to be between about 2 hours and about 100 hours.

In some embodiments, the port assembly 32 comprises a protective coating (not shown) for protecting the outer layer 36 from being exposed to fluids external to the port sub 20, such as wellbore fluids, to prevent premature disintegration of the outer layer 36 at its outer surface. The protective coating may abut against the outer layer 36 or may be spaced apart from the outer layer 36 to define a second chamber therebetween. In some embodiments, the protective coating may comprise a burst disk and/or a dissolvable material, such as one or more of a mastic, rubber, steel, stainless steel, and other suitable material as known to those skilled in the art. In some embodiments, the protective coating is configured to rupture and/or disintegrate without being displaced into the wellbore, and accordingly, without leaving debris in the wellbore that could block flow paths and impeded production of the subterranean formation. In some embodiments, the protective coating may be omitted where the outer layer 36 is not exposed to wellbore fluids when the port assembly 32 is in the intact position, for example when the port sub is meant to be installed inside a downhole tubing, and is therefore shielded from external wellbore fluids.

Figure 3:
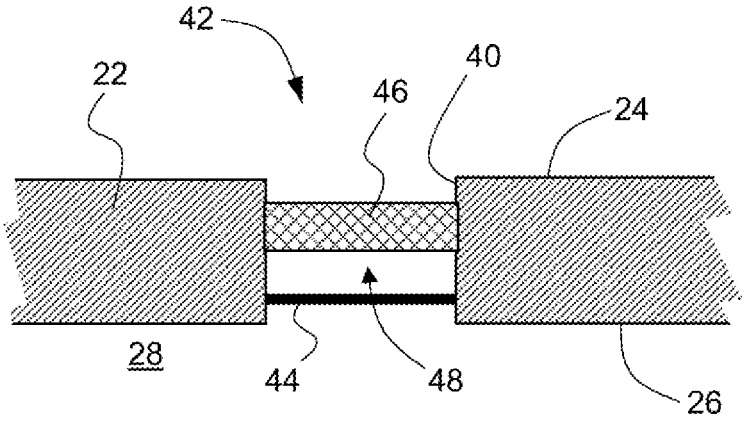
FIG. 3 is a cross-sectional view of a high-pressure port assembly disposed in a control flow port of the port sub of FIG. 1. The high-pressure port assembly is shown in an intact position.

FIG. 3 shows a sample embodiment of a high-pressure port assembly 42. The high-pressure port assembly 42 may be wholly or partially disposed in the control flow port 40. In some embodiments, the high-pressure port assembly 42 is positioned between the outer surface 24 and inner surface 26 of wall 22. In other embodiments, at least a portion of the port assembly 42 extends beyond the inner surface 26 and/or outer surface 24 of the wall 22. In some embodiments, the port assembly 42 is secured to the wall 22 of the port sub by threaded connection. The port assembly 42 is configured to control the opening of its corresponding control flow port 40 as described in detail below.

Port assembly 42 generally comprises an inner layer 44 (also referred to as "high-pressure inner layer") and an outer layer 46 (also referred to as "high-pressure outer layer"). The port assembly 42 is disposed in the wall 22 of the port sub such that the inner layer 44 is adjacent to the inner surface 26 and the outer layer 46 is adjacent to the outer surface 24. The inner layer 44, when intact, separates the outer layer 46 from the inner bore 28. In some embodiments, the outer layer 46, when intact, is configured to shield the inner layer 44 from fluid pressures outside the port sub. When both the inner layer 44 and outer layer 46 are intact, a chamber 48 is defined between an inner surface of the outer layer 46 and the outer surface of the inner layer 44. In some embodiments, at least a portion of the outer layer 46 is spaced apart from the inner layer 44 to define chamber 48. In some embodiments, chamber 48 contains a compressible fluid. In some embodiments, the fluid in chamber 48 is at about atmospheric pressure.

The port assembly 42 has an intact position and an open position. The port assembly 42 is shown in the intact position in FIG. 3, wherein the inner layer 44 and outer layer 46 are intact to block (i.e., close) the control flow port 40 to restrict fluid flow through port 40. In the open position, both the inner layer 44 and the outer layer 46 are broken to provide a flow passage through which fluid can flow, thereby opening the control flow port 40.

In some embodiments, inner layer 44 is a burst disk having a rupture pressure. However, the rupture pressure of the burst disk of inner layer 44 is selected to be greater than that of the burst disk of low-pressure inner layer 34 such that the high-pressure port assembly 42 can remain intact during cementing operations and casing pressure testing. For example, the rupture pressure of inner layer 44 may be about 10,000 psi. The chamber 48 provides a space for the burst disk 44 to expand into when the burst disk ruptures.

In some embodiments, the outer layer 46 comprises a burst disk having a rupture pressure. In other embodiments, the outer layer 46 comprises a dissolvable barrier, as described above with respect to low-pressure port assembly 32 in FIG. 2. In further embodiments, the outer layer 46 may be a combination of one or more burst disks and/or one or more dissolvable barriers.

In some embodiments, where the outer layer 46 is a burst disk, the burst disk of outer layer 46 is selected to have a much lower rupture pressure than that of inner layer 44 (and that of inner layer 34). In some embodiments, the rupture pressure of outer layer 46 is around 1% of the rupture pressure of the inner layer 44. For example, the burst disk of the inner layer 44 may have a rupture pressure of about 10,000 psi (and the burst disk of inner layer 34 may have a rupture pressure of about 8,000 psi) while the rupture pressure of the burst disk of the outer layer 46 may be about 80 psi. Accordingly, in some embodiments, much less pressure is required to rupture outer layer 46 than the inner layer 44, such that the outer layer 46 is broken almost immediately after the inner layer 44 is broken. As a result, control flow port 40 can be opened almost instantaneously by selectively increasing the pressure inside port sub 20 to the rupture pressure of burst disk of inner layer 44.

In some embodiments, where the outer layer 46 is a dissolvable barrier, the overall thickness of the dissolvable barrier may be chosen to minimize the breakthrough time of the dissolvable barrier such that the dissolvable barrier disintegrates almost immediately after the inner layer 44 is broken. In some embodiments, the overall thickness of the dissolvable barrier of outer layer 46 is about 1/16".

In some embodiments, an amount of dehydrated corrosive material may be disposed in chamber 48 or is embedded in outer layer 46. The dehydrated corrosive material is for accelerating the disintegration of the outer layer 36 of low-pressure port assembly 32 when the corrosive material is introduced into the wellbore when the outer layer 46 is broken. Once introduced into the wellbore, the corrosive material mixes with wellbore fluids to form a dissolve fluid that can flow into the wellbore and may come into contact with one or more of the other port assemblies in the port sub. The corrosive material may be for example sulfuric acid, anhydrous $H_2SO_4$, and/or anhydrous HF, and may be in powder form or pill form.

Figure 4:
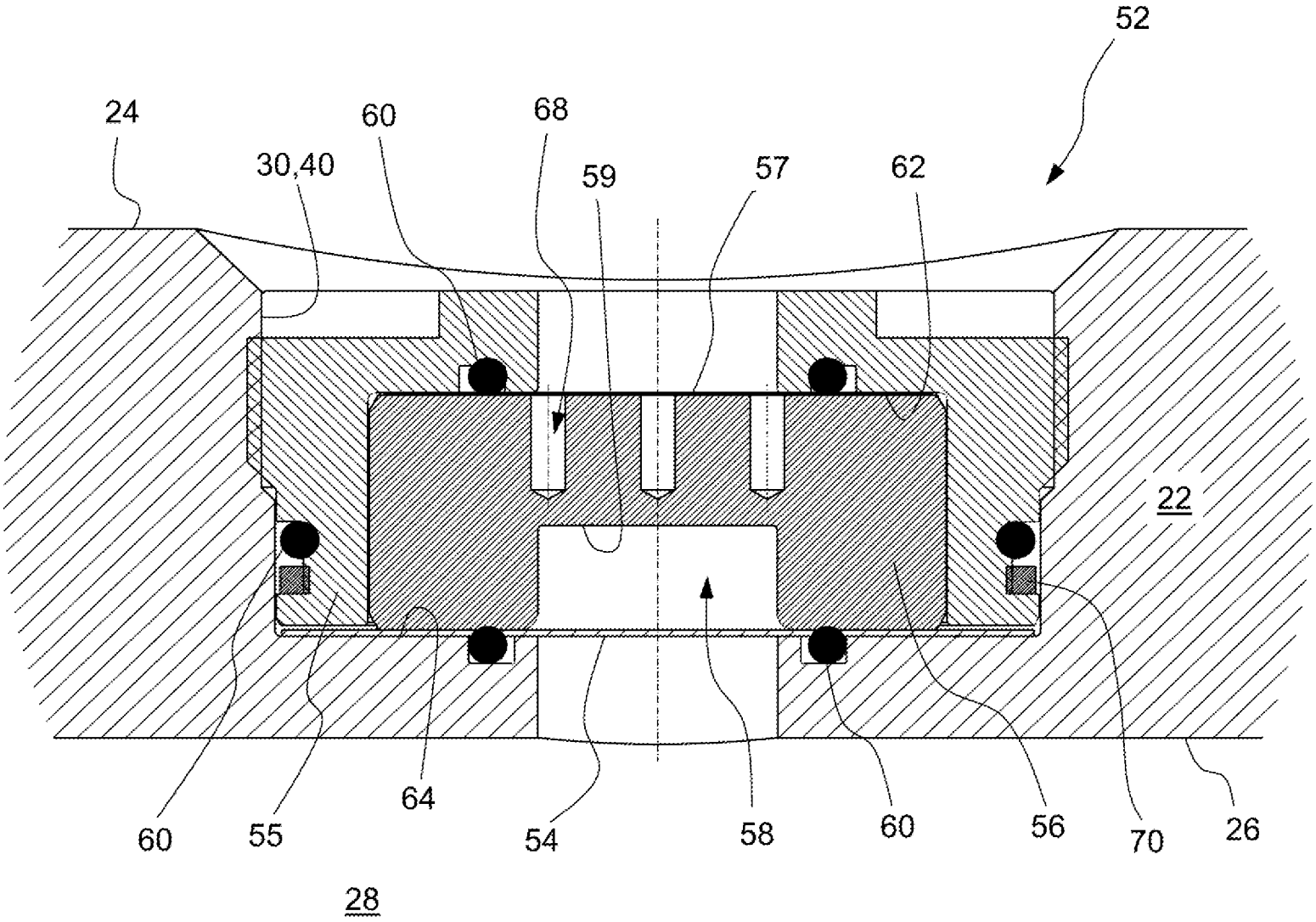
FIG. 4 is a cross-sectional view of an exemplary port assembly that is usable for the low-pressure port assembly and/or the high-pressure port assembly, according to one embodiment.

FIG. 4 shows a sample configuration of a port assembly 52 that can be used for the low-pressure port assembly 32 and/or the high-pressure port assembly 42. In FIG. 4, the port assembly 52 is shown in an intact position. The port assembly 52 comprises an inner layer 54 and an outer layer 56. In the illustrated embodiment, the inner layer 54 is a burst disk and the outer layer 56 is a dissolvable barrier. In some embodiments, the port assembly 52 comprises a protective coating 57 adjacent to the outer surface of outer layer 56. The protective coating 57 is as described above with respect to port assembly 32 in FIG. 2.

The port assembly 52 is positioned in the wall 22 of the port sub such that the inner layer 54 is adjacent to the inner surface 26 and the outer layer 56 is adjacent to the outer surface 24. In the intact position, outer layer 56 shields the inner layer 54 from fluid pressures outside the port sub, while inner layer 54 fluidly separates the outer layer 56 from the inner bore 28.

In the illustrated embodiment, a recess is defined on the inner surface 59 of the outer layer 56 such that when outer layer 56 is placed against the inner layer 54, the recessed portion of the inner surface 59 is spaced apart from inner layer 54 while the non-recessed portion of the inner surface 59 is in direct contact with inner layer 54. A chamber 58 is thus defined between the recess of inner surface 59 and the outer surface of inner layer 54. The properties and function of chamber 58 are the same or similar to those described above with respect to chambers 38,48 in FIGS. 2 and 3.

In some embodiments, the port assembly 52 comprises a retainer member 55 for securing the outer layer 56 and inner layer 54 (and optionally the protective coating 57) in the wall 22 of the port sub. In the illustrated embodiment, the retainer member 55 is an annular member having an inner surface defining an inner bore for receiving at least a portion of the outer layer 56. In some embodiments, the inner surface of the retainer member 55 has defined thereon an inward-facing shoulder 62. The inward-facing shoulder 62 may be positioned adjacent one end of the inner bore of the retainer member 55. The retainer member 55 is configured to fit in the flow port 30,40 and may be externally threaded such that the retainer member 55 may be secured to the wall 22 by threaded connection. Other configurations of the retainer member 55 and other ways of attaching the retainer member 55 to the wall 22 are possible. In the illustrated embodiment, the wall 22 has an outward-facing shoulder 64 for supporting the port assembly 52 when the port assembly 52 is disposed in the flow port.

By configuring the outer layer 56 to define an inner recess, the chamber 58 can be formed between the inner layer 54 and outer layer 56 without the use of a separate spacer member, which may help minimize the number of components in the port assembly 52 and simplify the manufacturing and assembly of the port assembly 52. In the illustrated embodiment, the port assembly 52 only requires a single retainer member 55 to hold the inner layer 54 and outer layer 56 in place.

In some embodiments, one or more of the interfaces in the port sub, for example, between: the inner layer 54 and the wall 22; the retainer member 55 and the wall 22; and the retainer member 55 and the outer layer 56, may be fluidly sealed by one or more seals 60. Seal 60 may be for example an O-ring. Other types of seals known to those skilled in the art may also be used. In some embodiments, one or more retainer rings 70 may be used to hold any of the seals 60 in place.

To install the port assembly 52 in the flow port 30,40, the inner layer 54 is placed into the flow port to abut against the outward-facing shoulder 64. A seal 60 may be placed on the shoulder 64 prior to inserting the inner layer 54. The outer layer 56 is then placed into the flow port, with the recess of the inner surface 59 facing the inner layer, such that a portion of the inner surface 59 abuts against the outer surface of the inner layer 54 and the recessed portion of the inner surface 59 is spaced apart from the inner layer 54 to define the chamber 58. The retainer member 55 is then placed over the outer surface of outer layer 56 in the flow port 30,40. A seal 60 may be placed on the circumference of the retainer member 55 and/or on shoulder 62 prior to inserting the retainer member 55 into the flow port 30,40. The retainer member 55 can be secured to the wall 22 by rotating the retainer member 55 to engage the threaded connection between the retainer member 55 and the wall 22. In other embodiments, the outer layer 56 is placed into the inner bore of the retainer member 55 first and then the retainer member 55 and the outer layer 56, together, are inserted into the flow port 30,40 at the same time.

When the port assembly 52 is assembled (i.e., installed in the flow port 30,40), the retainer member 55 is secured to the wall 22 and at least a portion of outer layer 56 is received in the inner bore of the retainer member 55. In some embodiments, when the port assembly 52 is assembled, at least a portion of the outer layer 56 abuts against inward-facing shoulder 62 of the retainer member 55, such that outward movement of the inner layer 54 and outer layer 56 is restricted to prevent the inner and outer layers from being dislodged from the flow port 30,40 when the port assembly 52 is in the intact position. In some embodiments, when the port assembly 52 is assembled, a portion of the inner surface of the inner layer 54 abuts against outward-facing shoulder 64, such that inward movement of the port assembly 52 is restricted. When the port assembly 52 is assembled, the retainer member 55 may or may not abut against the inner surface of inner layer 54 or outward-facing shoulder 64. The port assembly 52, thus assembled, is free of a spacer member between the inner layer 54 and the outer layer 56.

In some embodiments, where the outer layer 56 is a dissolvable barrier, the breakthrough time of the dissolvable barrier can be varied by adjusting the depth of the recess on inner surface 59. In some embodiments, the deeper the recess, the shorter the breakthrough time of the outer layer 56, and vice versa. In some embodiments, to further reduce the breakthrough time of the outer layer 56, the outer layer 56 may have one or more holes 68 defined therein to provide one or more areas of reduced thickness. In the illustrated embodiment, a first end of each hole 68 is at or near the outer surface of the outer layer 56 and each hole 68 extends toward but does not reach the inner surface 59. As a result, there is at least some thickness of the material of the dissolvable barrier adjacent a second end of each hole 68. As one skilled in the art can appreciate, the recess and holes 68 are two of the many possible ways to provide areas of reduced thickness (i.e., "thinner areas") in the dissolvable barrier of outer layer 56. The thinner areas generally disintegrate more quickly than the surrounding thicker areas of the dissolvable barrier, which may assist in reducing the breakthrough time.

The configuration of the dissolvable barrier of outer layer 56 includes: the overall thickness of the dissolvable barrier; the thickness of the thinner areas if the dissolvable barrier has one or more thinner areas; and/or the number of thinner areas. In some embodiments, the breakthrough time of the dissolvable barrier of outer layer 56 can be preselected by using a dissolvable barrier of a specific thickness and/or with a specific number of thinner areas each having a predetermined thickness. If the port assembly 52 is used as a high-pressure port assembly in a control flow port 40, the dissolvable barrier of outer layer 56 may be configured to have a very short breakthrough time to allow the outer layer 56 to be broken almost immediately after the inner layer 54 is ruptured.

Referring back to FIGS. 1 to 3, in operation, port sub 20 is connected to a downhole tubing that is run into a wellbore. The port assemblies 32,42, disposed in ports 30,40, respectively, are initially in the intact position. After running in, the tubing may or may not be cemented to the wellbore. In some embodiments, the port sub 20 is positioned at the distal end of the tubing such that the port sub 20 is at or near the toe of the wellbore.

Once the port sub 20 is in place, fluid is pumped down the inner bore of the tubing and the pressure inside the tubing and the port sub is increased. In the case of a casing pressure test, the pressure inside the tubing is increased to at least the test pressure. Per above, the inner layer 34 of low-pressure port assembly 32 is selected to have a rupture pressure less than or equal to the test pressure such that inner layer 34 is ruptured during the pressure test. After the inner layer 34 of the low-pressure port assembly 32 bursts as a result of the increased pressure inside the port sub 20, the port assembly 32 is placed in the interim position wherein standard flow port 30 remains blocked by the outer layer 36, but the outer layer 36 is exposed to the fluid inside the port sub 20. The intact outer layer 36 thus prevents each standard flow port 30 from becoming immediately opened when the inner layer 34 is ruptured. The inner layer 44 of high-pressure port assembly 42 is selected to have a rupture pressure greater than the test pressure such that inner layer 44 (and therefore the high-pressure port assembly 42) remains intact during the pressure test.

After the pressure testing is completed, the standard flow ports 30 remain closed due to the presence of outer layer 36 and control flow port 40 is still blocked by the intact high-pressure port assembly 42, such that there is no fluid communication between the inner bore 28 and the space external to the port sub 20. The standard flow ports 30 and the control flow port 40 can be selectively opened, sometime after the completion of the casing pressure test, as described below to allow fluid communication between inner bore 28 and the space external to the port sub 20.

When desired, the pressure inside the tubing and the port sub is increased to or above the rupture pressure of high-pressure inner layer 44 to break open the inner layer 44. In some embodiments, the high-pressure outer layer 46 is broken almost immediately after the rupture of inner layer 44, thereby opening port 40. Once control flow port 40 is opened, fluid is permitted to flow from inner bore 28 out of port sub 20. A dissolve fluid can then be introduced into the inner bore 28 via the tubing and be permitted to flow out of the port sub 20 via the open port 40. As a result, the outer layer 36 are exposed to the dissolve fluid from the inside and outside of the port sub, to help ensure that the outer layer 36 are broken through as quickly as possible upon the introduction of the dissolve fluid into the port sub 20. In lieu of or in addition to introducing the dissolve fluid, the high-pressure port assembly 42 may include a corrosive material that is released upon the opening of the inner layer 44 and/or outer layer 46 to assist with the disintegration of outer layer 36. Once outer layers 36 are broken through, the standard flow ports 30 become opened to allow fluid communication between the inner bore 28 and the space external to the port sub via the standard flow ports 30.

Accordingly, the port sub described herein has delayed opening flow ports and is configured to provide more control over the selective opening of the flow ports. The present disclosure provides a port sub with a plurality of ports that can be selectively opened, for example, at a desired time after the completion of a casing pressure test of a downhole tubing having the port sub.

According to a broad aspect of the present disclosure, there is provided a port sub comprising one or more flow ports, each having a low-pressure port assembly positioned therein to block fluid flow therethrough, and at least one control flow port having a high-pressure port assembly positioned therein to block fluid flow therethrough. The low-pressure port assembly comprises an inner layer having a first rupture pressure and an outer layer configured to remain intact upon the rupturing of the inner layer. The high-pressure port assembly comprises an inner layer having a second rupture pressure that is greater than the first rupture pressure. The high-pressure port assembly is configured to be broken through upon the rupturing of its inner layer to allow fluid flow through the at least one control flow port, thereby allowing a dissolve fluid to flow therethrough to facilitate the disintegration of the outer layer of the low-pressure port assembly to open the one or more flow ports.

According to another broad aspect of the present disclosure, there is provided a method for controlling opening of one or more flow ports in a port sub, the port sub having at least one control flow port, each of the one or more flow ports having a respective low-pressure port assembly blocking fluid flow through the one or more flow ports, and the at least one control flow port having a high-pressure port assembly blocking fluid flow through the at least one control flow port, the method comprising: increasing a pressure inside the port sub to a first pressure to partially rupture the low-pressure port assembly without unblocking the one or more flow ports; increasing the pressure inside the port sub to a second pressure, the second pressure being greater than the first pressure, to break through the high-pressure port assembly to unblock the at least one control flow port; and introducing a dissolve fluid into the port sub to dissolve a remainder of the low-pressure port assembly.

According to another broad aspect of the present disclosure, there is provided a port sub comprising: a tubular wall; one or more flow ports defined in the tubular wall, each of the one or more flow ports having positioned therein a respective low-pressure port assembly to block fluid flow through the one or more flow ports, the low-pressure port assembly comprising: a low-pressure inner layer having a first rupture pressure; and a low-pressure outer layer, an outer surface of the low-pressure inner layer and at least a portion of an inner surface of the low-pressure outer layer defining a first chamber therebetween; and at least one control flow port defined in the tubular wall, the at least one control flow port having positioned therein a high-pressure port assembly to block fluid flow through the at least one control flow port, the high-pressure port assembly comprising: a high-pressure inner layer having a second rupture pressure; and a high-pressure outer layer, an outer surface of the high-pressure inner layer and at least a portion of an inner surface of the high-pressure outer layer defining a second chamber therebetween, wherein the second rupture pressure is greater than the first rupture pressure.

According to another broad aspect of the present disclosure, there is provided a port assembly positioned in a flow port of a port sub having a wall through which the flow port extends, the port assembly comprising: a burst disk adjacent to a first end of the flow port; a dissolvable barrier adjacent to a second end of the flow port, the dissolvable barrier having an inner surface with a recessed portion and a non-recessed portion, the non-recessed portion being in direct contact with the burst disk and the recessed portion being spaced apart from the burst disk to define a chamber therebetween; and a retainer member attached to the wall for securing the burst disk and the dissolvable barrier in the flow port, wherein, when the burst disk and dissolvable barrier are intact, the burst disk and the dissolvable barrier block fluid flow through the flow port, wherein, when the burst disk is ruptured and dissolvable barrier is broken through, the flow port is opened to allow fluid flow therethrough, and wherein the dissolvable barrier is configured to be broken through after the burst disk is ruptured and after a breakthrough time has lapsed.

Unless the context clearly requires otherwise, throughout the description and the "comprise", "comprising", and the like are to be construed in an inclusive sense, as opposed to an exclusive or exhaustive sense; that is to say, in the sense of "including, but not limited to"; "connected", "coupled", or any variant thereof, means any connection or coupling, either direct or indirect, between two or more elements; the coupling or connection between the elements can be physical, logical, or a combination thereof; "herein", "above", "below", and words of similar import, when used to describe this specification, shall refer to this specification as a whole, and not to any particular portions of this specification; "or", in reference to a list of two or more items, covers all of the following interpretations of the word: any of the items in the list, all of the items in the list, and any combination of the items in the list; the singular forms "a", "an", and "the" also include the meaning of any appropriate plural forms.

Where a component is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims. All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples but should be given the broadest interpretation consistent with the description as a whole.

What is claimed is:

1. A port sub comprising:

a wall having defined therein a standard flow port and a control flow port;

an interior passage defined by the wall;

a low-pressure port assembly disposed in the standard flow port, the low-pressure port assembly comprising:

a low-pressure inner layer having a first rupture pressure; and a low-pressure outer layer, at least a portion of the low-pressure outer layer being spaced apart from the low-pressure inner layer to define a first chamber therebetween;

a high-pressure port assembly disposed in the control flow port, the high-pressure port assembly comprising:

a high-pressure inner layer having a second rupture pressure, the second rupture pressure being greater than the first rupture pressure;

a high-pressure outer layer configured to rupture immediately after rupturing of the high-pressure inner layer, at least a portion of the high-pressure outer layer being spaced apart from the high-pressure inner layer to define a second chamber therebetween;

the low-pressure port assembly is disposed in a closed configuration and is transitionable from the closed configuration to an open configuration, via a low-pressure port opening-ready configuration;

while the low-pressure port assembly is disposed in the closed configuration, the low-pressure inner layer and the low-pressure outer layer are intact such that there is an absence of flow communication between the inner passage and an environment external to the port sub wall, via the standard flow port;

while the low pressure port assembly is disposed in the low-pressure port opening-ready configuration, the low-pressure inner layer is defeated, while the low-pressure outer layer remains intact such that the low pressure outer layer is in flow communication with the inner passage while flow communication from the inner passage to the environment external to the port sub wall is prevented by the low pressure outer layer; and while the low pressure port assembly is disposed in the open configuration, the low-pressure outer layer is defeated such that flow communication between the inner passage and the environment external to the port sub wall, via the standard flow port is established;

and the high-pressure port assembly is disposed in a closed configuration and is transitionable from the closed configuration to an open configuration;

while the high-pressure port assembly is disposed in the closed configuration, there is an absence of flow communication from the inner passage to the environment external to the port sub wall, via the control flow port;

while the high pressure port assembly is disposed in the open configuration, the high pressure inner layer and the high pressure outer layer are defeated such that flow communication from the inner passage to the environment external to the port sub wall, via the control flow port is established;

wherein:

the low-pressure port assembly and the high-pressure port assembly are co-operatively transitionable from a co-operating sealed configuration to a co-operating opening-effective configuration, wherein:

(i) in the co-operating sealed configuration, the low-pressure port assembly is disposed in the closed configuration and the high-pressure port assembly is disposed in the closed configuration; and (ii) in the co-operating opening-effective configuration, the low-pressure port assembly is disposed in the low-pressure port assembly opening-ready configuration and the high pressure port assembly is disposed in the open configuration, such that: (i) while the port sub is emplaced within a wellbore, (ii) the co-operating opening-effective configuration is established, and (iii) a degradation-promoting agent is being supplied to the interior passage:

the degradation-promoting agent becomes emplaced, within the inner passage of the port sub in communication with the low-pressure outer layer of the low pressure port assembly; and the degradation-promoting agent becomes emplaced, externally of the port sub wall, in communication with the low-pressure outer layer of the low-pressure port assembly, with effect that degradation of the low-pressure outer layer is effected by the degradation-promoting agent.

2. The port sub of claim 1 wherein:

transitioning of the low-pressure port assembly from the closed configuration to the low-pressure port assembly opening-ready configuration is effected in response to pressure within the inner passage reaching the first rupture pressure; and transitioning of the high-pressure port assembly from the closed configuration to the open configuration is effectuated in response to pressure within the inner passage reaching at least the second rupture pressure.

3. The port sub of claim 1 wherein the high-pressure outer layer has a third rupture pressure, the third rupture pressure being less than the second rupture pressure or the first rupture pressure;

and transitioning of the high-pressure port assembly from the closed configuration to the open configuration is effectuated in response to pressure within the inner passage reaching the second rupture pressure such that the high-pressure outer layer is defeated simultaneously with or immediately after defeating of the high-pressure inner layer.

4. The port sub of claim 3 wherein the third rupture pressure is around 1% of the second rupture pressure.

5. The port sub of claim 1 wherein the first rupture pressure is a test pressure of a downhole tubing in a wellbore.

6. The port sub of claim 1 wherein the low-pressure outer layer is a dissolvable barrier configured to dissolve when exposed to the degradation-promoting agent; and the low-pressure inner layer is a burst disk.

7. The port sub of claim 1 wherein the high-pressure inner layer is a burst disk and the high-pressure outer layer is a burst disk or a dissolvable barrier.

8. The port sub as claimed in claim 1, wherein: a dehydrated corrosive material is disposed in the second chamber or embedded in the high-pressure outer layer such that, while the high-pressure port assembly is disposed in the open configuration, the dehydrated corrosive material is released into the inner passage and the environment external to the port sub for contact with the low pressure outer layer.

9. A method for selectively opening a plurality of flow ports in a port sub for establishing flow communication between a port sub inner passage and an environment external to the port sub, the plurality of flow ports comprising a standard flow port and a control flow port, the standard flow port having a low-pressure port assembly disposed therein, the control flow port having a high-pressure port assembly disposed therein, the low-pressure port assembly and the high-pressure port assembly each, independently, being disposed in a closed configuration and transitionable to an open configuration, wherein:

while the low-pressure port assembly and the high-pressure port assembly are each, independently, disposed in the closed configuration, the low-pressure port assembly blocks fluid flow through the standard flow port and the high-pressure port assembly blocks fluid flow through the control flow port such that there is an absence of flow communication from the port sub inner passage to the environment external to the port sub via the standard flow port and the control flow port; and while the low-pressure port assembly and the high-pressure port assembly are each, independently, disposed in the open configuration, the low-pressure port assembly is defeated such that there is an absence of blocking of fluid flow through the standard flow port such that flow communication from the port sub inner passage to the environment external to the port sub, via the standard flow port, is established, and the high-pressure port assembly is defeated such that there is an absence of blocking of fluid flow through the control flow port such that flow communication from the port sub inner passage to the environment external to the port sub, via the control flow port, is established; the method comprising:

(i) increasing a pressure inside the port sub to a first predetermined pressure to rupture a first portion of the low-pressure port assembly, leaving a remaining portion of the low-pressure port assembly disposed in a sealing configuration that is effective to continue to block the standard flow port such that there is an absence of fluid communication from the port sub inner passage to the environment external to the port sub through the standard flow port, and an absence of fluid communication from the port sub inner passage to the environment external to the port sub through the control flow port;

(ii) increasing the pressure inside the port sub to a second predetermined pressure, wherein the second predetermined pressure is greater than the first predetermined pressure and is effective to defeat the high-pressure port assembly and unblock the control flow port such that the control flow port is disposed in the open configuration; and (iii) introducing a degradation-promoting agent into the port sub such that:

(a) the degradation-promoting agent is emplaced within the port sub inner passage and is disposed in communication with the remaining portion of the low-pressure port assembly, via the port sub inner passage; and (b) the degradation-promoting agent is emplaced within the environment external to the port sub, via communication through the control flow port, and in communication with the remaining portion of the low-pressure port assembly;

and emplacement of the degradation-promoting agent within the port sub inner passage and within the environment external to the port sub is with effect that degradation of the remaining portion of the low-pressure port assembly is effected by the degradation-promoting agent such that the low-pressure port assembly transitions to the open configuration.

10. The method of claim 9 comprising, prior to increasing the pressure inside the port sub to the first pressure, connecting the port sub to a downhole tubing and running the downhole tubing into a wellbore.

11. The method of claim 10 wherein connecting the port sub comprises connecting the port sub to a distal end of the downhole tubing and wherein running the downhole tubing into the wellbore comprises running the downhole tubing into the wellbore until the port sub is adjacent a toe of the wellbore.

12. The method of claim 9 wherein increasing the pressure comprises introducing a fluid into the port sub via an inner bore of the downhole tubing.

13. The method as claimed in claim 9, wherein:

the high-pressure port assembly comprises a dehydrated corrosive material; and defeating of the high-pressure port assembly is effective for releasing the dehydrated corrosive material such that the dehydrated corrosive material is disposed in contact with the remainder of the low-pressure port assembly in the standard flow port via the inner passage and via the environment external to the port sub.

14. A port sub comprising:

a wall having defined therein a standard flow port and a control flow port;

a low-pressure port assembly disposed in the standard flow port, the low-pressure port assembly comprising:

a low-pressure inner layer having a first rupture pressure; and a low-pressure outer layer, at least a portion of the low-pressure outer layer being spaced apart from the low-pressure inner layer to define a first chamber therebetween, the low-pressure port assembly having an intact position, an interim position, and an open position, wherein in the intact position, both the low-pressure inner layer and low-pressure outer layer are intact; in the interim position, the low-pressure inner layer is ruptured and the low-pressure outer layer is intact; and in the open position, the low-pressure inner layer is ruptured and the low-pressure outer layer is broken through;

a high-pressure port assembly disposed in the control flow port, the high-pressure port assembly comprising:

a high-pressure inner layer having a second rupture pressure, the second rupture pressure being greater than the first rupture pressure; and a high-pressure outer layer configured to rupture immediately after rupturing of the high-pressure inner layer, at least a portion of the high-pressure outer layer being spaced apart from the high-pressure inner layer to define a second chamber therebetween, the high-pressure port assembly having an intact position and an open position, wherein in the intact position, both the high-pressure inner layer and high-pressure outer layer are intact; and in the open position, both the high-pressure inner layer and the high-pressure outer layer are ruptured, wherein each of the high-pressure inner layer and the high-pressure outer layer is a burst disk, and wherein the high-pressure port assembly is free of a dissolvable barrier.

15. The port sub of claim 14 wherein:

when the low-pressure port assembly is in the intact position and the interim position, fluid flow through the standard flow port is restricted; and when the low-pressure port assembly is in the open position, fluid flow through the standard flow port is permitted; or when the high-pressure port assembly is in the intact position, fluid flow through the control flow port is restricted; and when the high-pressure port assembly is in the open position, fluid flow through the control flow port is permitted.

16. The port sub of claim 14 wherein the high-pressure outer layer has a third rupture pressure, the third rupture pressure being less than the second rupture pressure or the first rupture pressure.

17. The port sub of claim 16 wherein the third rupture pressure is around 1% of the second rupture pressure.

18. The port sub of claim 14 wherein the first rupture pressure is a test pressure of a downhole tubing in a wellbore.

19. The port sub of claim 14 wherein the low-pressure outer layer is a dissolvable barrier configured to dissolve when exposed to a dissolve fluid; or the low-pressure inner layer is a burst disk.

20. A port sub comprising:

a housing;

a flow passage, defined within the housing;

a standard flow port extending through the housing, from the flow passage to the environment external to the housing, for effecting fluid communication between the flow passage and the environment external to the housing;

a control flow port extending through the housing, from the flow passage to the environment external to the housing, for effecting fluid communication between the flow passage and the environment external to the housing;

a standard flow port sealing configuration including a first end sealing surface and a second end sealing surface, wherein the second end sealing surface is disposed at an opposite end of the standard flow port sealing configuration relative to the first end sealing surface;

wherein:

the standard flow port sealing configuration is co-operable with a degradation-promoting agent such that:

degradation of the standard flow port sealing configuration is effected in response to emplacement of the degradation-promoting agent in a degradation-effective communication with the first end sealing surface; and degradation of the standard flow port sealing configuration is effected in response to emplacement of the degradation-promoting agent in a degradation-effective communication with the second end sealing surface;

and a control flow port sealing configuration;

wherein:

the standard flow port and the standard flow port sealing configuration co-operate to define a standard flow port flow controller, wherein the standard flow port flow controller is disposed in a closed configuration and transitionable from the closed configuration to an open configuration, wherein:

in the closed configuration, fluid communication, via the standard flow port, between the flow passage and the environment external to the housing, is sealed by the standard flow port sealing configuration; and in the open configuration, there is an absence of sealing of fluid communication, via the standard flow port, between the flow passage and the environment external to the housing, such that fluid communication, via the standard flow port, is established between the flow passage and the environment external to the housing;

the control flow port and the control flow port sealing configuration co-operate to define a control flow port flow controller, wherein the control flow port flow controller is disposed in a closed configuration and is transitionable from the closed configuration to an open configuration, wherein:

in the closed configuration, fluid communication, via the control flow port, between the flow passage and the environment external to the housing, is sealed by the control flow port sealing configuration; and in the open configuration, there is an absence of sealing of fluid communication, via the control flow port, between the flow passage and the environment external to the housing, such that fluid communication is established, via the control flow port, between the flow passage and the environment external to the housing;

the standard flow port flow controller and the control flow port flow controller are co-operatively configured for transitioning from a co-operating sealed configuration to a co-operating opening-effective configuration, wherein:

in the co-operating sealed configuration, the standard flow port flow controller is disposed in the closed configuration and the control flow port flow controller is disposed in the closed configuration; and in the co-operating opening-effective configuration, the standard flow port flow controller is disposed in the closed configuration and the control flow port flow controller is disposed in the open configuration;

the standard flow port flow controller and the control flow port flow controller are co-operatively configured such that, while: (i) the port sub is emplaced within a wellbore, and (ii) the co-operating opening-effective configuration is established:

degradation-promoting agent is emplaceable within the flow passage in the degradation-effective communication with the standard flow port sealing configuration via the first end sealing surface and also via the second end sealing surface, such that a degradation-effective configuration is established, with effect that the degradation-effective communication with the first end sealing surface and the degradation-effective communication with the second end sealing surface co-operate for effecting degradation of the standard flow port sealing configuration;

the degradation-effective communication with the standard flow port sealing configuration, via the first end sealing surface, is established in the absence of communication via the environment external to the housing; and the degradation-effective communication with the standard flow port sealing configuration, via the second end sealing surface, is established via the control flow port and the environment external to the housing.

21. The port sub as claimed in claim 20, wherein:

the standard flow port flow controller and the control flow port flow controller are co-operatively configured for transitioning from the co-operating opening-effective configuration to an open configuration, wherein, in the open configuration, the standard flow port configuration is disposed in the open configuration and the control flow port configuration is disposed in the open configuration, and wherein the transitioning from the co-operating opening-effective configuration to the open configuration is effected by, at least, the degradation of the standard flow port sealing configuration by the co-operation between the degradation-effective communication with the first end sealing surface of the standard flow port sealing configuration and the degradation-effective communication with the second end sealing surface of the standard flow port sealing configuration.

22. The port sub as claimed in claim 21, wherein:

the standard flow port sealing configuration includes a leachable metal, the degradation-promoting agent includes a lixiviant, and the co-operation between the standard flow port sealing configuration and the degradation-promoting agent is such that the emplacement of the degradation-promoting agent in the respective degradation-effective communication with the standard flow port sealing configuration is with effect that the leachable metal, of the standard flow port sealing configuration, becomes leached by the lixiviant, of the degradation-promoting agent, such that the degradation of the standard flow port sealing configuration, by the co-operation between: (i) the degradation-effective communication with the first end sealing surface of the standard flow port sealing configuration, and (ii) the degradation-effective communication with the second end sealing surface of the standard flow port sealing configuration, includes leaching of the leachable metal of the standard flow port sealing configuration.

23. The port sub as claimed in claim 20, wherein:

the extending of the standard flow port, from the flow passage, is via an internal standard flow port communicator, and the extending of the standard flow port, to the environment external to the housing, is via an external standard flow port communicator, wherein the standard flow port configuration and the control flow port configuration are further co-operatively configured such that:

the degradation-effective communication with the standard flow port sealing configuration, via the first end sealing surface, is established via the internal standard flow port communicator; and the degradation-effective communication with the standard flow port sealing configuration, via the second end sealing surface, is established via the external standard flow port communicator.

24. The port sub as claimed in claim 20, wherein:

the control flow port sealing configuration is configurable in a sealing-effective configuration and a sealing-defeating ready configuration;

wherein:

the sealing-effective configuration includes:

an inner barrier; and an outer barrier;

the sealing effective configuration and the control flow port are co-operatively configured such that:

the inner barrier is spaced apart from the outer barrier such that a control flow port sealing configuration chamber is established;

the inner barrier is effective for sealing fluid communication between the flow passage and the control flow port configuration chamber;

the outer barrier is effective for sealing fluid communication between the control flow port sealing configuration chamber and the environment external to the housing;

the control flow port flow controller is disposed in the closed configuration while the control flow port sealing configuration is disposed in the sealing-effective configuration;

and the sealing of flow communication, for which the inner barrier is effective, is defeatable in response to application of an inner barrier-defeating fluid pressure and only if the inner barrier-defeating fluid pressure is equal to or greater than an inner barrier-defeating minimum predetermined pressure, wherein the defeating is with effect that the control flow port configuration transitions from the sealing-effective configuration to the sealing defeating-ready configuration such that, in the sealing defeating-ready configuration, the outer barrier is effective for sealing fluid communication between the flow passage and the environment external to the housing, wherein the inner barrier-defeating minimum predetermined pressure is independent of the pressure of the external environment, such that the control flow port flow controller is disposed in the closed configuration while the control flow port sealing configuration is disposed in the sealing defeating-ready configuration.

25. The port sub as claimed in claim 24, wherein:

the standard flow port flow controller and the control flow port flow controller are co-operatively configured such that the inner barrier-defeating minimum predetermined pressure is a pressure that is ineffective for effecting transitioning of the standard flow port flow controller from the closed configuration to the open configuration.

26. The port sub as claimed in claim 25, wherein:

the standard flow port flow controller and the control flow port flow controller are co-operatively configured such that, while the standard flow port flow controller configuration is disposed in the closed configuration and the control flow port flow controller is disposed in the sealing-defeating ready configuration:

the sealing of fluid communication, for which the outer barrier is effective, is defeatable, in response to application of an outer barrier-defeating stimulus, and with effect that the control flow port flow controller transitions from the closed configuration to the open configuration; and the outer barrier-defeating stimulus is ineffective for effecting transitioning of the standard flow port flow controller from the closed configuration to the open configuration.

27. The port sub as claimed in claim 26; wherein:

the control flow port flow controller is configured such that the inner barrier-defeating minimum predetermined pressure is a fluid pressure that is effective for defeating the sealing of fluid communication, for which the outer barrier is effective, with effect that the control port flow controller transitions from the closed configuration to the open configuration, such that the outer barrier-defeating stimulus is the inner barrier-defeating minimum predetermined pressure.

28. The port sub as claimed in claim 26, wherein:

the outer barrier-defeating stimulus is an outer barrier-defeating fluid pressure, and the outer barrier-defeating fluid pressure is a pressure that is greater than an outer barrier-defeating minimum predetermined pressure; and the inner barrier-defeating minimum predetermined pressure is greater than the outer barrier-defeating minimum predetermined pressure.

29. The port sub as claimed in claim 28, wherein:

the inner barrier is a first burst disk;

the outer barrier is a second burst disk.

30. The port sub as claimed in claim 26, wherein:

the outer barrier is co-operable with the degradation-promoting agent such that the emplacement of the degradation-promoting agent, in a degradation-effective communication with the outer barrier, is with effect that the sealing of fluid communication, between the flow passage and the environment external to the housing, is defeated, such that the application of an outer barrier-defeating stimulus, in response to which the sealing of fluid communication, for which the outer barrier is effective, is defeatable, is the emplacement of the degradation-promoting agent in a degradation-effective communication with the outer barrier.

31. The port sub as claimed in claim 26, further comprising:

the degradation-promoting agent;

wherein:

the degradation-promoting agent and the control flow port flow controller are co-operatively configured such that:

while the control flow port sealing configuration is disposed in the sealing-effective configuration, the degradation-promoting agent is retained by the control flow port sealing configuration; and in response to the transitioning of the control flow port flow controller from the closed configuration to the open configuration, the emplacement of the degradation-promoting agent in the degradation-effective communication with the standard flow port sealing configuration via the first end sealing surface and also via the second end sealing surface is established.

32. The port sub as claimed in claim 31, wherein:

the retention of the degradation-promoting agent by the control flow port sealing configuration includes disposition of the degradation-promoting agent within the control flow port sealing configuration chamber.

33. The port sub as claimed in claim 26, further comprising:

the degradation-promoting agent;

wherein:

the degradation-promoting agent and the control flow port flow controller are co-operatively configured such that:

while the control flow port flow controller is disposed in the closed configuration, the degradation-promoting agent is embedded within the outer barrier; and in response to the transitioning of the control flow port flow controller from the closed configuration to the open configuration, the degradation-promoting agent becomes released such that the emplacement of the degradation-promoting agent in the degradation-effective communication with the standard flow port sealing configuration via the first end sealing surface and also via the second end sealing surface is established.

34. The port sub as claimed in claim 20;

wherein:

the standard flow port flow controller and the control flow port flow controller are co-operatively configured such that, while: (i) the port sub is emplaced within a wellbore, (ii) the co-operating opening-effective configuration is established, and (iii) the degradation-promoting agent is being supplied to the flow passage, the emplacement of the degradation-promoting agent, in the degradation-effective communication with the standard flow port sealing configuration via the first end sealing surface and also via the second end sealing surface, is established.

* * * * *